US012466608B2

(12) United States Patent
Dean et al.

(10) Patent No.: US 12,466,608 B2
(45) Date of Patent: Nov. 11, 2025

(54) EYEWEAR DISPENSING ASSEMBLY

(71) Applicant: O&M Halyard, Inc., Mechanicsville, VA (US)

(72) Inventors: Marshall R. Dean, Cumming, GA (US); Eric C. Steindorf, Roswell, GA (US); Khoa T. Lien, Alpharetta, GA (US); Frank J. Walker, III, Duluth, GA (US)

(73) Assignee: O&M Halyard, Inc., Glen Allen, VA (US)

( * ) Notice: Subject to any disclaimer, the term of this patent is extended or adjusted under 35 U.S.C. 154(b) by 203 days.

(21) Appl. No.: 18/364,686

(22) Filed: Aug. 3, 2023

(65) Prior Publication Data

US 2024/0043168 A1 Feb. 8, 2024

Related U.S. Application Data

(60) Provisional application No. 63/395,004, filed on Aug. 4, 2022.

(51) Int. Cl.
*B65D 5/72* (2006.01)
*B65D 85/62* (2006.01)

(52) U.S. Cl.
CPC ..... *B65D 5/724* (2013.01); *B65D 5/725* (2013.01); *B65D 85/62* (2013.01)

(58) Field of Classification Search
CPC ..... B65D 5/725; B65D 5/5035; B65D 5/724; B65D 17/161; B65D 85/00; B65D 85/62;
(Continued)

(56) References Cited

U.S. PATENT DOCUMENTS 1,119,213 A 12/1914 Abt
1,344,147 A * 6/1920 Potter ..... B65D 5/5045 229/125.05
(Continued)

FOREIGN PATENT DOCUMENTS

DE 199 57 0536 A1 5/2001
EP 0242674 A3 * 4/1987 ..... B65D 71/36
(Continued)

OTHER PUBLICATIONS

International Search Report and Written Opinion for PCT/US2023/029377, dated Oct. 27, 2023, 13 pages.

*Primary Examiner* — Rakesh Kumar
(74) *Attorney, Agent, or Firm* — Dority & Manning, P.A.

(57) ABSTRACT

A dispensing assembly includes a dispenser having a front panel, a rear panel, a top panel, a bottom panel, a first side panel, and a second side panel that define an internal chamber configured to receive a plurality of articles. The dispenser includes a dispensing opening. At least a portion of the dispensing opening is formed in the front panel, and may extend a width of the panel, e.g., from the first side panel to the second side panel. The dispensing assembly further includes a shelf contained within the internal chamber and configured to facilitate the removal of an individual article from within the internal chamber in an efficient manner. The dispensing assembly further includes an insert configured to maintain the stack of articles in a predetermined arrangement within the internal chamber. The insert comprises at least one retaining flap configured to be coupled with the top panel of the dispenser.

17 Claims, 7 Drawing Sheets

(58) Field of Classification Search
CPC ..... B65D 2583/00; B65D 83/0027; A45C 11/005
USPC ..... 221/303, 277
See application file for complete search history.

(56) References Cited

U.S. PATENT DOCUMENTS

| | | | | | |
|---|---|---|---|---|---|
| 1,378,534 | A | | 5/1921 | Fitzgerald | |
| 1,875,781 | A | | 9/1932 | Turner | |
| 3,040,881 | A | * | 6/1962 | Mcneill | A47F 7/021 206/5 |
| 3,280,987 | A | * | 10/1966 | Steinbock | A47F 7/17 206/394 |
| 3,351,208 | A | * | 11/1967 | Siegel | A47F 7/021 248/902 |
| 3,450,308 | A | | 6/1969 | Schoenefeld | |
| 3,836,007 | A | * | 9/1974 | Rosenwein | A47F 7/021 116/75 |
| 3,858,726 | A | * | 1/1975 | Rosenwein | A47F 7/021 206/5 |
| 3,891,092 | A | * | 6/1975 | Surrette | A47F 7/021 211/163 |
| 3,924,750 | A | * | 12/1975 | Dunchock | A47F 7/021 248/902 |
| 4,083,482 | A | * | 4/1978 | Strenczewilk | B65D 71/0003 D7/706 |
| 4,150,752 | A | * | 4/1979 | Breining | A47F 7/021 211/2 |
| 4,211,331 | A | * | 7/1980 | Salmon | A47F 5/02 211/163 |
| 4,252,236 | A | | 2/1981 | Roccaforte | |
| 4,405,044 | A | * | 9/1983 | Flower | A61B 50/10 229/203 |
| 5,056,683 | A | | 10/1991 | O'Brien et al. | |
| D322,905 | S | | 1/1992 | Decker | |
| 5,143,210 | A | | 9/1992 | Warwick et al. | |
| 5,284,293 | A | | 2/1994 | Alpern et al. | |
| 5,425,474 | A | | 6/1995 | Dalea et al. | |
| 5,447,253 | A | | 9/1995 | Williams | |
| 5,690,230 | A | | 11/1997 | Griffith | |
| 5,842,441 | A | * | 12/1998 | Gjerlov | B65D 5/5038 119/650 |
| 6,443,317 | B1 | * | 9/2002 | Brozak, Jr. | A47F 7/021 211/85.1 |
| 6,598,737 | B2 | | 7/2003 | Rudnick | |
| 7,100,794 | B2 | | 9/2006 | Sakamoto | |
| 7,290,659 | B1 | * | 11/2007 | Chou | B25C 5/1693 206/445 |
| 8,118,212 | B2 | * | 2/2012 | Miller | B65D 5/703 221/48 |
| 9,546,031 | B2 | * | 1/2017 | Healy | B65D 77/0413 |
| 10,543,955 | B1 | * | 1/2020 | Turturro | B65D 5/724 |
| 11,273,951 | B1 | | 3/2022 | DuBois et al. | |
| 11,427,378 | B2 | | 8/2022 | Schultz et al. | |
| 2004/0155098 | A1 | * | 8/2004 | Harrelson | B65D 71/34 206/427 |
| 2005/0199688 | A1 | | 9/2005 | Fogle et al. | |
| 2013/0206787 | A1 | | 8/2013 | Shiell | |
| 2014/0319205 | A1 | * | 10/2014 | Schultz | B65D 5/0245 229/122.1 |
| 2015/0203282 | A1 | * | 7/2015 | Umentum | B65D 5/724 221/259 |
| 2019/0039776 | A1 | * | 2/2019 | Kioroglou | B65D 5/4208 |
| 2019/0217988 | A1 | | 7/2019 | Umentum et al. | |
| 2020/0317391 | A1 | * | 10/2020 | Schultz | B65D 5/725 |
| 2021/0253299 | A1 | * | 8/2021 | Dean | B65D 5/62 |

FOREIGN PATENT DOCUMENTS

| | | | | | |
|---|---|---|---|---|---|
| EP | 0242674 | A2 | * | 10/1987 | B65D 5/725 |
| EP | 1 604 904 | A1 | | 12/2005 | |
| FR | 3 040 987 | A1 | | 3/2017 | |
| GB | 755009 | A | * | 8/1956 | B65D 5/725 |
| GB | 2 268 159 | A | | 1/1994 | |
| GB | 2442755 | A | * | 4/2008 | A47F 1/06 |
| WO | WO-9808461 | A2 | * | 3/1998 | B05B 11/1059 |
| WO | WO-0076881 | A1 | * | 12/2000 | B65B 25/008 |
| WO | WO-2012047510 | A1 | * | 4/2012 | B65D 71/36 |
| WO | WO-2020152446 | A1 | * | 7/2020 | B65D 83/76 |

* cited by examiner

EYEWEAR DISPENSING ASSEMBLY

RELATED APPLICATIONS

The present application claims priority to U.S. Provisional Application Ser. No. 63/395,004, filed on Aug. 4, 2022, which is incorporated herein in its entirety by reference thereto.

FIELD OF THE INVENTION

The present invention relates in general to a dispensing assembly, and more particularly to an eyewear (e.g., face shield, safety glasses, goggle, etc.) dispensing assembly and methods of making same.

BACKGROUND OF THE INVENTION

A variety of single use, disposable products such as eyewear (e.g., face shields, safety glasses, goggles, etc.), face masks, gloves, and the like are often packaged in bulk in dispensing cartons. These dispensing cartons frequently have an opening or dispensing orifice cover for removal of the articles individually from the carton.

Because such single use, disposable products are often used in healthcare settings as personal protective equipment (PPE) to prevent hazardous biological fluids from coming into contact with healthcare professionals, it is important for healthcare professionals to have efficient and easy access to these products.

In the case of protective eyewear in particular, single use, disposable products may be shipped in a container or box in bulk, and the products may remain the container or box until needed. When a face shield, protective glasses, or goggles is needed, a healthcare worker typically locates the container, opens the container, removes a single face shield, pair of glasses, or goggles from the container, and then closes the container. This process can be time-consuming, particular in a fast-paced healthcare environment where the amount of time to don personal protective equipment can make a difference in patient outcomes. Further, it is common for eyewear to be shipped separately and then need to be assembled by the user, which elevates the need for a user to assemble. In this regard, it would be helpful if the packaging in which the eyewear was shipped could provide a consistent means of storing and dispensing the eyewear, where eyewear is typically handled in a loose bulk polybag.

As such, a need exists for new and improved dispensing assemblies for dispensing personal protective equipment (PPE) products. More specifically, assemblies that effectively dispense individual products, e.g., eyewear (e.g., face shields, safety glasses, goggles, etc.) without a risk of the additional products in the dispenser being dispensed as well would be welcomed in the art in order to reduce waste. The need for such assemblies is particularly apparent for larger volume packages having contents that move around substantially and may be easily removed from a dispenser opening, particularly in a health care environment.

BRIEF SUMMARY OF THE INVENTION

Aspects and advantages of the invention will be set forth in part in the following description, or may be obvious from the description, or may be learned through practice of the invention.

The present invention is directed to a dispensing assembly. The assembly includes a dispenser having a dispensing opening, a shelf, and an insert. The dispenser has a front panel, a rear panel, a top panel, a bottom panel, a first side panel, and a second side panel. The front panel, the rear panel, the top panel, the bottom panel, the first side panel, and the second side panel define an internal chamber configured to receive a stack of articles. At least a portion of the dispensing opening is formed in the front panel. A portion of the front panel forms a nose extending toward the dispensing opening to assist with one-by-one dispensing of articles from the stack through the dispensing opening. A first side of the opening is defined by the first side panel and a second side of the opening is defined by the second side panel. The shelf is contained within the internal chamber. The insert is configured to maintain the stack of articles in a predetermined arrangement within the internal chamber. The insert comprises at least one retaining flap configured to be coupled with the top panel of the dispenser.

In one particular embodiment, the insert may be configured to be inserted into the internal chamber through the top panel of the dispenser, and at least a portion of the insert may remain outside the internal chamber when the insert is inserted through the top panel of the dispenser.

In another embodiment, the insert can include a body extending in a vertical direction within the internal chamber. Further, the body can have a first side and a second side generally parallel to the first side, and the first side and the second side of the body can be configured to be disposed perpendicular to the front panel and the rear panel of the dispenser. Moreover, the body may be configured to be disposed generally parallel to the first side panel and the second side panel of the dispenser. Further, the insert can have a bottom edge extending between the first side of the insert and the second side of the insert, and the insert can further have a first angled edge extending between the first side of the insert and the bottom edge and a second angled edge extending between the second side of the insert and the bottom edge, wherein the first angled edge and the second angled edge each extend at an angle in a range from about 10° to about 80°. relative to the bottom edge. Moreover, the angle of the first angled edge and/or second angled edge may correspond to an angle of the shelf.

In an additional embodiment, the shelf can have a ramp, wherein the ramp is configured to be disposed at an angle relative to a horizontal plane, wherein the angle is in a range from about 20° to about 80°. Further, the shelf can have a front panel extending generally parallel to the front panel of the dispenser, further wherein the ramp extends from the front panel of the shelf in a direction towards the rear panel of the dispenser. Moreover, the shelf can include a recessed reach-in portion formed through at least a portion of the front panel of the shelf and at least a portion of the ramp of the shelf. Further, the shelf can include a bottom panel, wherein the bottom panel of the shelf comprises an attachment configured to be coupled with the dispenser.

In yet another embodiment, at least a portion of the dispensing opening may be formed in the bottom panel. Further, the assembly can include a reach-in access feature defined by at least a portion of the dispensing opening and at least a portion of the shelf. Moreover, the reach-in access feature can be formed by a recessed reach-in portion of the shelf. Further, the reach-in access feature may be formed by the portion of the dispensing opening formed in the bottom panel. Moreover, the portion of the dispensing opening formed in the bottom panel and a recessed reach-in portion of the shelf may be aligned in a vertical direction, wherein the vertical direction extends from the top panel to the bottom panel.

In a further embodiment, at least one of the front panel, the rear panel, the top panel, the bottom panel, the first side panel, and the second side panel may be constructed of carton cardboard stock, paperboard, heavy structural paper, container stock, corrugated paperboard, plastic coated paper, a plastic sheet, a wax-coated paper, or a combination thereof.

In another embodiment, the shelf and the insert may each be constructed of carton cardboard stock, paperboard, heavy structural paper, container stock, corrugated paperboard, plastic coated paper, a plastic sheet, a wax-coated paper, or a combination thereof.

In still another embodiment, the articles may include personal protective equipment. Further, the personal protective equipment may include protective eyewear in the form of a face shield, glasses, or goggles.

In one more embodiment, the assembly may include a dust cover insert configured to cover an entirety of the dispensing opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
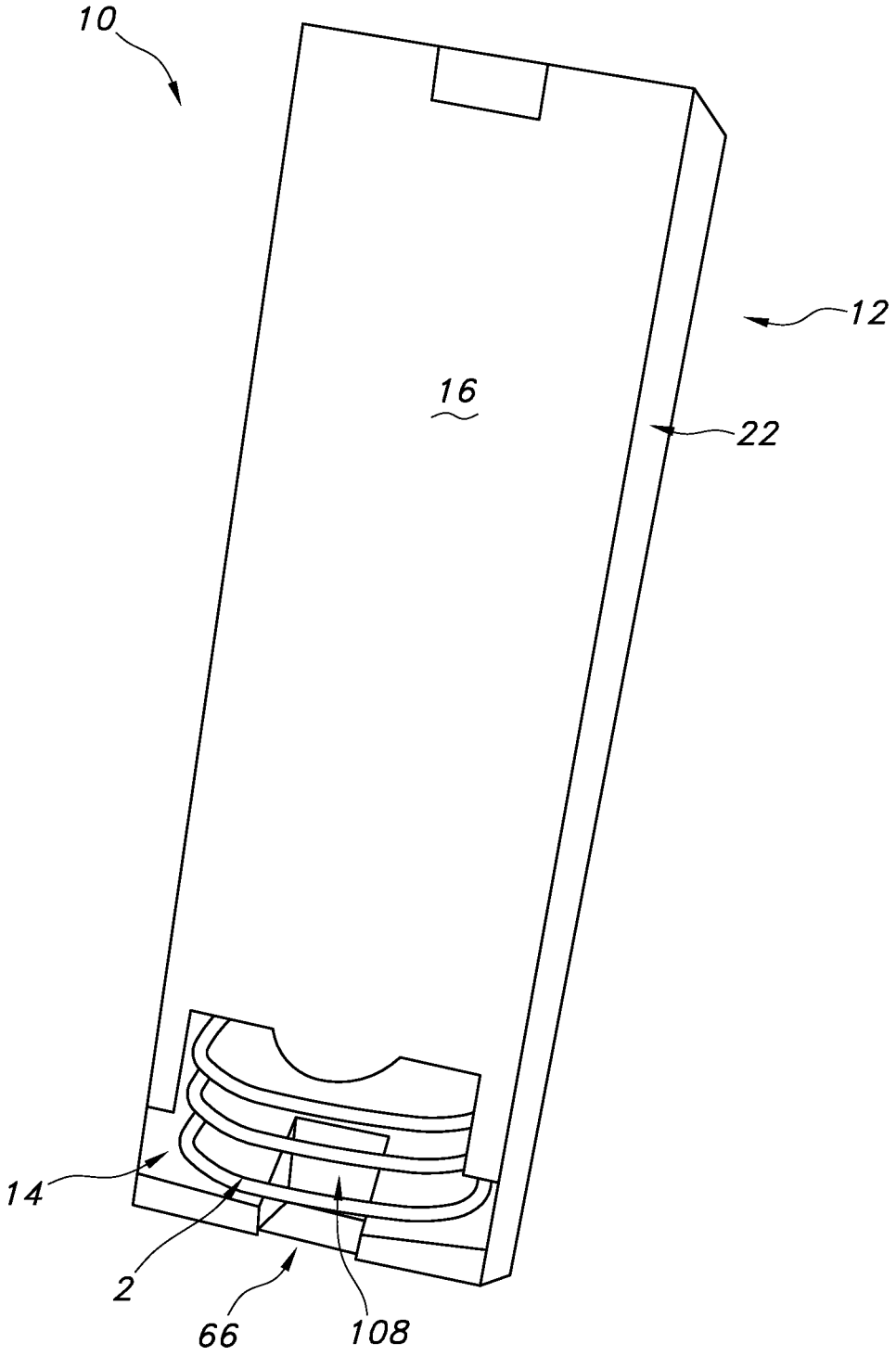
FIG. 1 illustrates a perspective view of one embodiment of a dispensing assembly for dispensing a plurality of articles, such as eyewear (e.g., face shields) according to the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally speaking, the present invention is directed to a dispensing assembly for dispensing articles, such as personal protective equipment including but not limited to disposable eyewear (e.g., face shields, safety glasses, goggles, etc.), face masks, gloves, etc. The dispensing assembly includes a dispenser having a plurality of panels (e.g., a front panel, a rear panel, a top panel, a bottom panel, a first side panel, and a second side panel) that define an internal chamber configured to receive a stack of articles. The dispenser includes a dispensing opening. At least a portion of the dispensing opening is formed in one of the panels, e.g., the front panel, and may extend a width of the panel, e.g., from the first side panel to the second side panel. The dispensing assembly further includes a shelf contained within the internal chamber. The dispensing assembly further includes an insert configured to maintain the stack of articles in a predetermined arrangement within the internal chamber. The insert comprises at least one retaining flap configured to be coupled with the top panel of the dispenser. The present inventors have found that the specific design of the insert allows it to function as a retention mechanism for the articles within the dispenser and that the specific design of the shelf allows it to function as a ramp to facilitate the removal of an individual article from within the internal chamber in an efficient manner. Moreover, the present inventors have found that the specific design of the insert can prevent tangling of articles within the container from occurring during shipping or storage.

Referring now to the drawings, FIG. 1 illustrates a perspective view of one embodiment of a dispensing assembly 10 for dispensing a plurality of articles 2, such as eyewear (e.g., face shields) according to the present disclosure. The dispensing assembly 10 includes a dispenser 12 having a dispensing opening 14, and a shelf 90 disposed within the dispenser 12 that is configured to position the articles 2 within the dispenser 12 to facilitate dispensing of the articles from the assembly of an exemplary dispensing assembly 10 or package for dispensing the articles 2 such as, for example, disposable eyewear (e.g., face shields, safety glasses, goggles, etc.) face masks, examination gloves, paper products (e.g., tissues, paper towels, etc.), dust mitts, or the like. The dispensing assembly 10 includes an insert 120 configured to retain the articles 2 in a predetermined arrangement, e.g., a stack, within the dispenser 12 in order to maintain the relative orientation of each of the articles 2. The arrangement of the insert 120 relative to the dispenser 12 and the articles 2 can create a support for the articles and prevent tangling of the articles within the dispenser 12. Further, the dispensing assembly 10 may include a dust cover 80 configured to be inserted within the dispenser 12 to cover the dispensing opening 14, e.g., to prevent dust or other debris from entering the dispenser 12 through the dispensing opening 14 when the dust cover 80 is in place. The dispenser 12, shelf 90, insert 120 and dust cover 80 each may be constructed of any suitable material such as, for example, carton cardboard stock, paperboard, heavy structural paper, container stock, corrugated paperboard, plastic coated paper, a plastic sheet, a wax-coated paper or the like, or a combination thereof.

Figure 2:
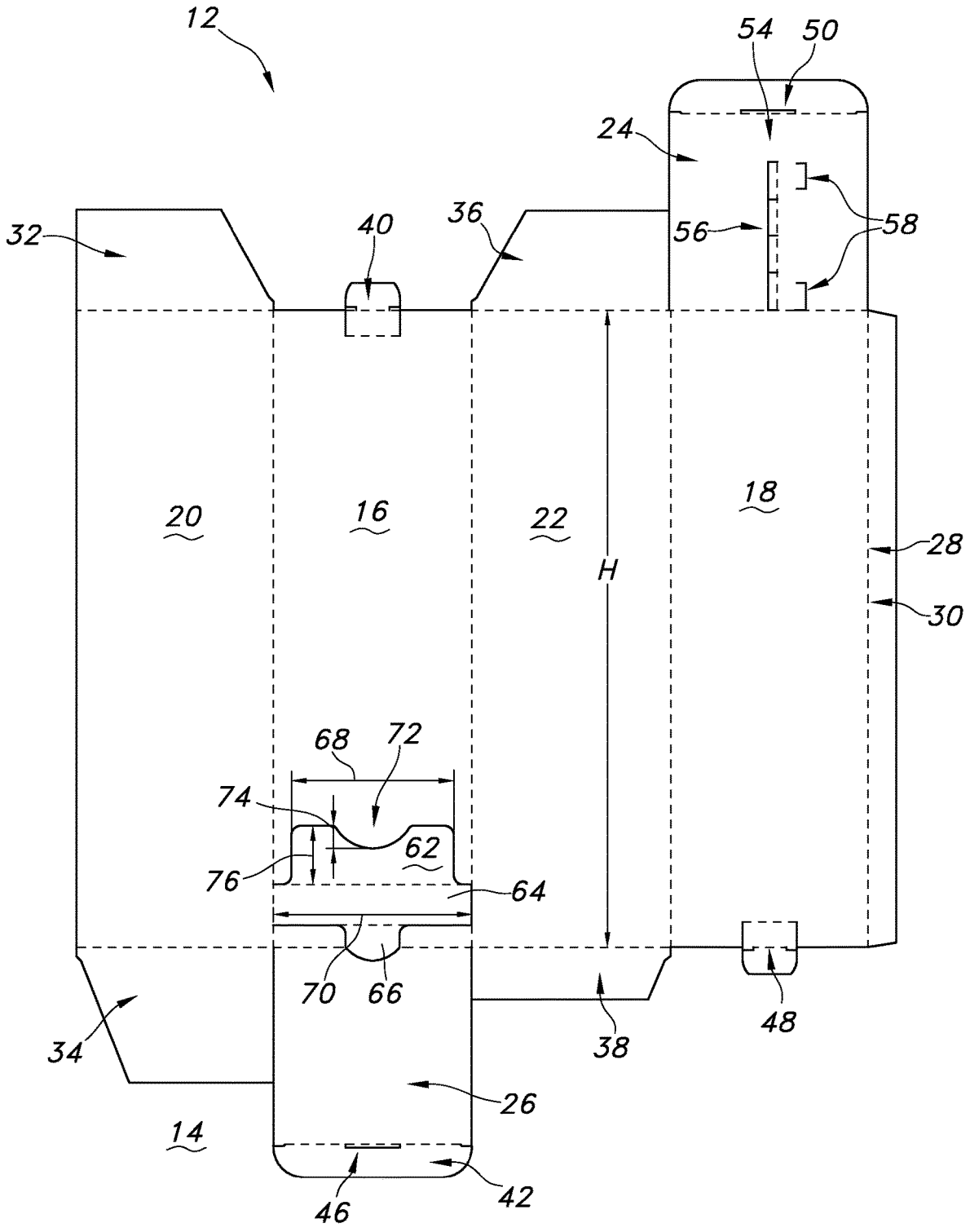
FIG. 2 illustrates a front view of an unassembled dispenser according to the present disclosure.

As shown in FIG. 2, the dispenser 12 includes a front panel 16, rear panel 18. a first side panel 20, a second side panel 22, a top panel 24, and a bottom panel 26. The front panel 16 and the rear panel 18 may be formed opposite each other when the dispenser 12 is in its assembled arrangement, e.g., as shown in FIG. 1. The first side panel 20 and the second side panel 22 may be formed opposite each other when the dispenser 12 is in the assembled arrangement. The top panel 24 and the bottom panel 26 may be formed opposite each other when the dispenser 12 is in the assembled arrangement. For instance, the front panel 16 and rear panel 18 may be generally parallel to each other. Similarly, the first side panel 20 and the second side panel 22 may be generally parallel to each other. Similarly still, the top panel 24 and the bottom panel 26 may be generally parallel to each other. Adjacent panels, e.g., the front panel 16 and the first side panel 20 or the rear panel 18 and the top panel 24, may have an angle in a range from about 70 degrees to about 110 degrees between the panel. For instance, adjacent panels, e.g., the front panel 16 and the first side panel 20 or the rear panel 18 and the top panel 24, may be disposed generally perpendicular to each other. In the described assembled arrangement, the front panel 16, rear panel 18, first side panel 20, second side panel 22, top panel 24, and bottom panel 24 may be constructed and arranged such that the assembled arrangement of the dispenser 12 takes on the form of a hexahedron, such as a rectangular prism.

As shown in FIG. 2, the dispenser 12 can be formed from a single piece of material such that all of the front panel 16, rear panel 18, first side panel 20, second side panel 22, top panel 24, and bottom panel 26 are formed from a single continuous piece of material and folded between the panels. The dispenser 12 may include an attachment panel 28 extending generally parallel to and extending from at least one of the front panel 16, rear panel 18, first side panel 20 and/or second side panel 22. The attachment panel 28 may be configured to be folded generally perpendicular relative to its adjacent panel and coupled to another one of the front panel 16, rear panel 18, first side panel 20 and/or second side panel 22 to maintain the front panel 16, rear panel 18, first side panel 20 and second side panel 22 in a generally rectangular shape. For instance, the attachment panel 28 may extend from the rear panel 18 and may be coupled to the first side panel 20 in the assembled arrangement of the dispenser 12. In one exemplary aspect of the invention, an adhesive or other coupling material may be applied to a front surface 30 of the attachment panel 28 and adhered to a back surface (not shown) of the first side panel 20 to couple the attachment panel 28 to the first side panel 20 in a manner that makes the first side panel 20 adjacent to and generally perpendicular to the rear panel 18.

The dispenser 12 may further include one or more additional fold panels and/or flaps configured to maintain the closed and folded arrangement of the dispenser 12. For instance, the first side panel 20 may have a first top fold panel 32 and/or a first bottom fold panel 34 extending from top and bottom edges of the first side panel 20, respectively. Similarly, the second side panel 22 may have a second top fold panel 36 and/or a second bottom fold panel 38 extending from top and bottom edges of the second side panel 22, respectively. Each of the first top fold panel 32, first bottom fold panel 34, second top fold panel 36, and second bottom fold panel 38 can have at least two free non-parallel edges (i.e., edges not directly in contact with the first side panel 20 and/or second side panel 22), for instance, three or more free non-parallel edges.

The one or more additional fold panels and/or flaps configured to maintain the closed and folded arrangement of the dispenser 12 may further include one or more insertion tabs configured to extend from one of the front panel 16, rear panel 18, first side panel 20, second side panel 22, top panel 24, and bottom panel 26 and configured to be inserted into a retaining opening in the dispenser 12 when the dispenser 12 is in the assembled arrangement. For instance, a rear bottom insertion tab 42 may extend from the bottom panel 26. The rear bottom insertion tab 42 may be configured to be inserted into an opening disposed along the bottom edge of the rear panel 18. For instance, the opening can be formed between a bottom edge of the rear panel 18 and one or more edges of the first bottom fold panel 34 and/or second bottom fold panel 38 that may extend generally parallel to or near the bottom edge of the rear panel 18 when the dispenser 12 is in the assembled arrangement. The rear bottom insertion tab 42 may have a width equal to or less than a width of the bottom panel 26. One or more cut lines may be formed along an edge between the bottom panel 26 and the rear bottom insertion tab 42, e.g., to aid insertion of the rear bottom insertion tab 42 into the opening and/or to receive a cooperating insertion tab. For example, a rear panel insertion tab 48 may extend from the rear panel 18 and may be inserted into an opening 46 along the edge between the bottom panel 26 and the rear bottom insertion tab 42.

Similarly, a front panel insertion tab 40 may extend from a top edge of the front panel 16 and a front top insertion tab 50 may extend from a front edge of the top panel 24. The front top insertion tab 50 may have a width equal to or less than a width of the top panel 24. One or more cut lines may be formed along an edge between the top panel 24 and the front top insertion tab 50, e.g., to aid insertion of the front top insertion tab 50 into an opening 52 and/or to receive the front panel insertion tab 40 therein. In particular, a cut line 54 may be formed along an edge between the top panel 24 and the front top insertion tab 50 to receive the front panel insertion tab 40.

The front panel insertion tab 40 may extend symmetrically along a vertical line of symmetry of the front panel 16 such that the front panel insertion tab 40 is centered along the top edge of the front panel 16. The front panel insertion tab 40 may extend the width of the front panel 16, or the front panel insertion tab 40 may be narrower than the front panel 16 in a width direction. The rear panel insertion tab 48 may have a similar arrangement with respect to the rear panel 18 as the front panel insertion tab 40 to the front panel 16, such that the rear panel insertion tab 48 is centered along a vertical line of symmetry of the rear panel 18. In some aspects of the present invention, it may be beneficial for the front panel insertion tab 40 and the rear panel insertion tab 48 to each have a width that is less than a width of the front panel 16 and rear panel 18, respectively, less than a width of the top panel 24 and bottom panel 26, respectively, and less than a width of the front top insertion tab 50 and the rear bottom insertion tab 42, respectively, such that the front panel insertion tab 40 and the rear panel insertion tab 48 may be retained along the edges of the front and rear panels without compromising the structural integrity of the front top insertion tab 50 and the rear bottom insertion tab 42, respectively.

When the dispenser 12 is in the assembled arrangement as shown in FIG. 1, an internal chamber 60 is formed between the front panel 16, rear panel 18, first side panel 20, second side panel 22, top panel 24, and bottom panel 26. The articles 2 may be inserted and stored within the internal chamber 60 and dispensed through the dispensing opening 14. The dispensing opening 14 may be formed in the front panel 16 as shown in FIG. 1. The dispensing opening 14 may extend a width from the first side panel 20 to the second side panel 22 at a widest point of the dispensing opening 14. The dispensing opening 14 may have an upper section 62, a lower section 64, and a bottom reach-in access section 66 arranged from top to bottom in a vertical direction of the front panel 16. The upper section 62 may have a width 68 that may be narrower than a width 70 of the lower section 64 and may be narrower than a width from the first side panel 20 to the second side panel 22. The upper section 62 may optionally include a nose 72 extending downward from the front panel 16 toward the lower section 64. The nose 72 can have a height 74 that is shorter than a maximum height 76 of the upper section. For instance, a ratio of the height 74 of the nose 72 to the height 76 of the upper section 62 of the opening 14 can be in a range from about 1:2 to about 1:8, such as from about 1:3 to about 1:4, so that the nose 72 can retain articles 2 within the opening 14 without preventing dispensing of the articles 2 through the opening 14. Similarly, a maximum width of the nose 72 may be less than the maximum width 68 of the upper section 62 of the opening 14. For instance, a ratio of the maximum width of the nose 72 to the width 68 of the upper section 62 of the opening 14 can be in a range from about 1:2 to about 1:8, such as from about 1:3 to about 1:4, so that the nose 72 can retain articles 2 within the opening 14 without preventing dispensing of the articles 2 through the opening 14. The lower section 64 may be the widest section of the dispensing opening 14 and may have a width extending a width from the first side panel 20 to the second side panel 22. The bottom reach-in access section 66 may be the narrowest relative section of the dispensing opening 14 compared to the upper section 62 and the lower section 64. The bottom reach-in access section 66 may extend from the front panel 16 into the bottom panel 26. The bottom reach-in access section 66 may extend symmetrically along a vertical line of symmetry of the front panel 16 such that the bottom reach-in access section 66 is centered along the bottom edge of the front panel 16.

The nose 72 of the front panel 16 extending downward into the upper section 62 of the dispensing opening 14 may aid in retaining the articles 2 within the internal chamber 60 when the dispensing opening 14 is open. For example, by virtue of the dimensions of the nose 72 relative to the opening 14, the nose 72 may particularly aid in improving ease of dispensing the articles 2 one at a time through the dispensing opening 14 by retaining or catching a subsequent article in a stack contained within the internal chamber 60. As a result, when the nose 72 catches on a subsequent article 2 in a stack, e.g., the nose 72 catches on a lens of a protective eyewear piece in the stack, the nose 72 prevents the subsequent article 2 from being dispensed as a "tag along" with the bottom article in the stack.

Figure 3:
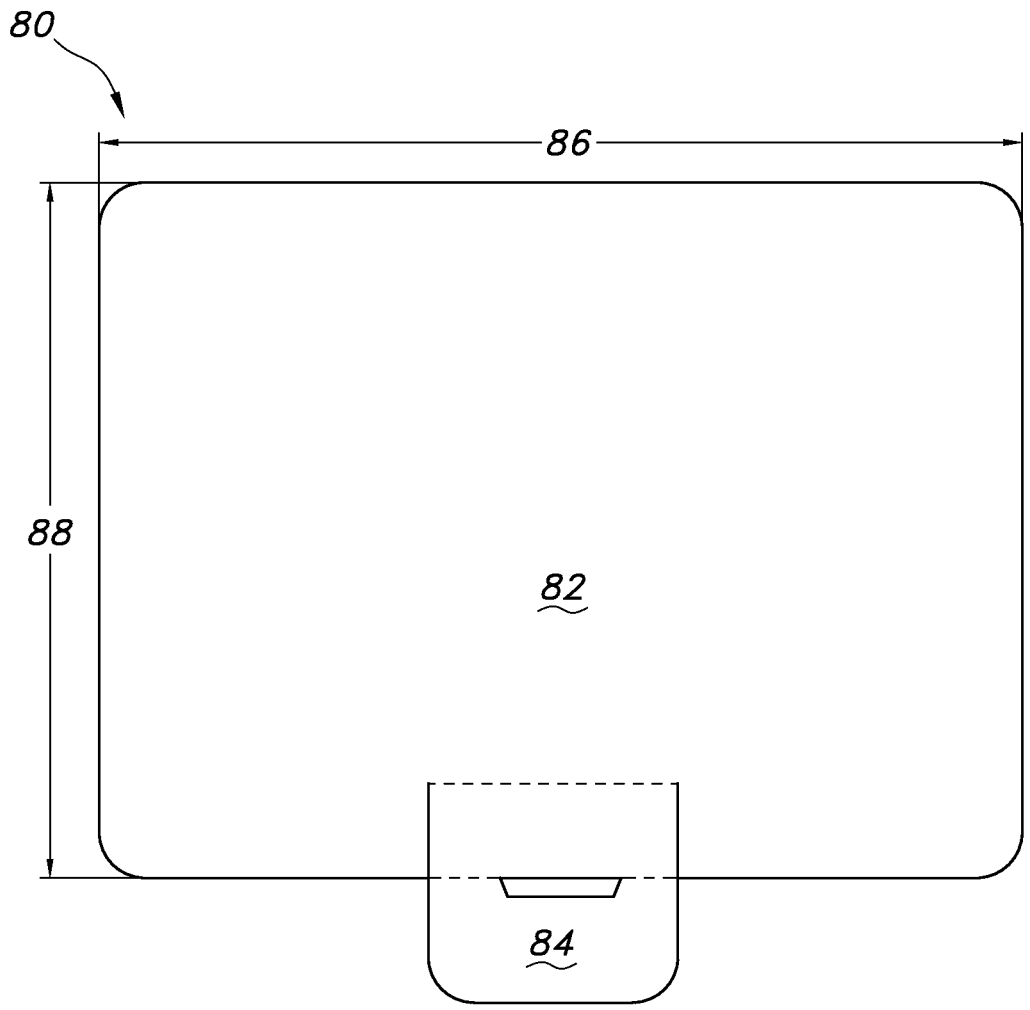
FIG. 3 illustrates a front view of an unassembled dust cover according to the present disclosure.

As shown in FIG. 3, the dispensing assembly 10 may further include a dust cover 80. The dust cover 80 may be configured to cover the entire dispensing opening 14 to protect the articles 2 within the internal chamber 60, e.g., during shipping, transport, and/or storage of the dispensing assembly 10. The dust cover 80 can have a body 82 and a bottom tab 84 extending from a bottom edge thereof. The body 82 can cover the portion of the dispensing opening 14 of the front panel 16 and the bottom tab 84 can cover the portion of the dispensing opening 14 of the bottom panel 26. The body 82 can have a width 86 and a height 88. The width 86 may be equal to or larger than the width 70 of the widest portion of the dispensing opening 14, e.g., a width from the first side panel 20 to the second side panel 22. The height 88 may be larger than a maximum height of the dispensing opening 14.

Figure 4:
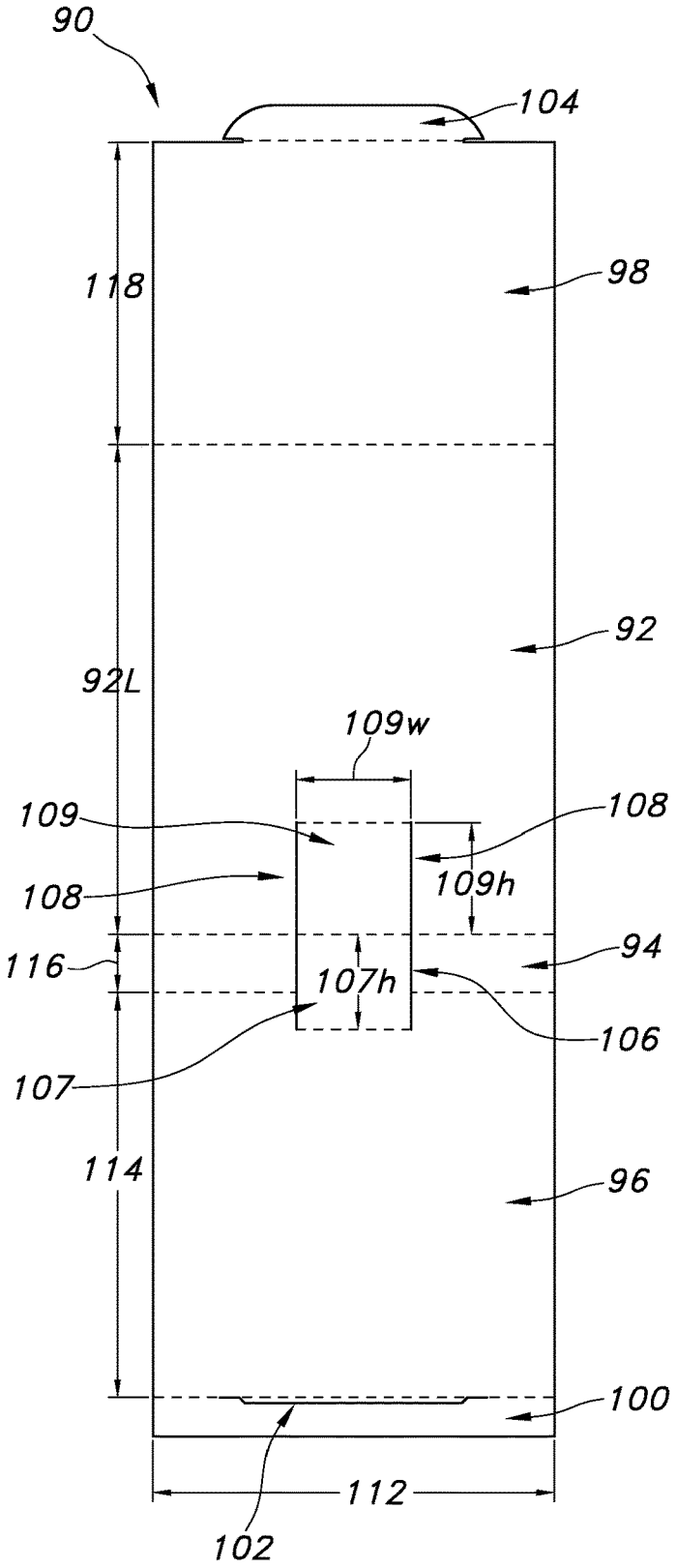
FIG. 4 illustrates a front view of an unassembled shelf according to the present disclosure.

Turning now to FIG. 4, the dispensing assembly 10 further includes a shelf 90 configured to be inserted within the internal chamber 60 of the dispenser 12. Specifically, the shelf 90 is configured to be seated on the bottom panel 26 of the dispenser 12 in the assembled arrangement such that the shelf 90 provides a shelf support for the articles 2 to be dispensed through the dispensing opening 14. The shelf 90 includes a ramp 92 configured to form a support for the articles 2 within the internal chamber 60. The shelf 90 further includes a front panel 94 that is configured to elevate the ramp 92 from the bottom panel 26 and generally align a front edge of the ramp 92 with a lower edge of the lower section 64 of the dispensing opening 14.

The shelf 90 may be formed from a single piece of material such that the entirety of the shelf 90, including the ramp 92 and the front panel 94, is formed from a single continuous piece of material and folded to form a three-dimensional support structure. For instance, the shelf 90 may further include a shelf bottom panel 96 and a shelf rear panel 98. The shelf bottom panel 96 may include a shelf attachment panel 100 extending therefrom. The shelf attachment panel 100 can be configured to be coupled to the ramp 92. For example, a shelf attachment cutout 102 can be formed along an edge between the shelf bottom panel 96 and the shelf attachment panel 100. The shelf rear panel 98 may include a shelf insertion tab 104 extending therefrom. The shelf insertion tab 104 can be configured to be folded along an edge of the shelf rear panel 98 and inserted within the shelf attachment cutout 102. The shelf 90 may be folded along respective parallel edges between the shelf rear panel 98, ramp 92, front panel 94, bottom panel 96 and shelf attachment panel 100 to form a three-dimensional shelf structure as shown in FIG. 5.

The shelf 90 may have a width 112 approximately equal to a width from the first side panel 20 to the second side panel 22 of the dispenser 12. The width 112 can be in a range from about 4 inches to about 7 inches, such as about 5 inches to about 6 inches, such as from about 5.125 inches to about 5.375 inches. Additionally, the shelf 90 may extend a front-to-rear depth 114 (see FIG. 5) approximately equal to a depth of the dispenser 12 from the front panel 16 to the rear panel 18. The depth 114 can be in a range from about 4 inches to about 7 inches, such as about 5 inches to about 6 inches, such as from about 5.25 inches to about 5.5 inches. In such an arrangement, the shelf 90 may form a support structure for the articles 2 within the internal chamber 60 that fully prevents the articles 2 from contacting the bottom panel 26 of the dispenser 12 and raises the articles 2 toward the dispensing opening 14. Moreover, as best seen in FIG. 5, the ramp 92 may be disposed at an angle $\alpha$ relative to a horizontal plane (i.e., relative to the bottom panel 96 of the shelf 90 and the bottom panel 26 of the dispenser 12). The angle $\alpha$ may be an acute angle, for instance, the angle $\alpha$ may be in a range from about 20° to about 80°. Specifically, as shown in FIG. 5, the ramp 92 may extend upwardly at the angle $\alpha$ from the front panel 94 of the shelf 90 so that the front edge of the ramp 92 forms a lower end of the ramp 92 and the ramp 92 extends upwardly towards a rear edge of the ramp 92 adjacent to the rear panel 98 of the ramp that forms an upper end of the ramp 92. The ramp 92 may have a length 92L extending between the front panel 94 and the rear panel 98 that is longer than the front-to-rear depth 114 of the shelf 90 in order to enable the ramp 92 to extend at the angle $\alpha$ described above. For instance, a ratio of the depth 114 to the length 92L can be in a range from about 1:1.05 to about 1:1.5, such as from about 1:1.1 to about 1:1.25, for instance about 1:1.2. The length 92L can be in a range from about 5 inches to about 9 inches, such as from about 5.5 inches to about 7.5 inches, such as from about 6 inches to about 7 inches, for instance about 6.5 inches in one embodiment of the invention.

The shelf 90 may have a front height 116, e.g., aligned with the shelf front panel 94 and the front edge of the ramp 92, and a rear height 118, e.g., aligned with the shelf rear panel 98 and the rear edge of the ramp 92. The front height 116 is shorter than the rear height 118. The front height 116 may be in a range from about 0.25 inches to about 1.5 inches, for example about 0.5 inches. The front height 116 may generally align above, below, or with the bottom edge of the lower section of the dispensing opening 14 such that the ramp 92 angles the articles 2 downward towards the dispensing opening 14 for ease of access and removal through the dispensing opening 14. In one particular aspect of the invention, the front height 116 may extend above the bottom edge of the lower section of the dispensing opening 14 such that the ramp 92 angles the articles 2 downward towards the dispensing opening 14 while preventing the articles 2 from being caught on the bottom edge of the lower section of the dispensing opening 14 during dispensing.

Figure 5:
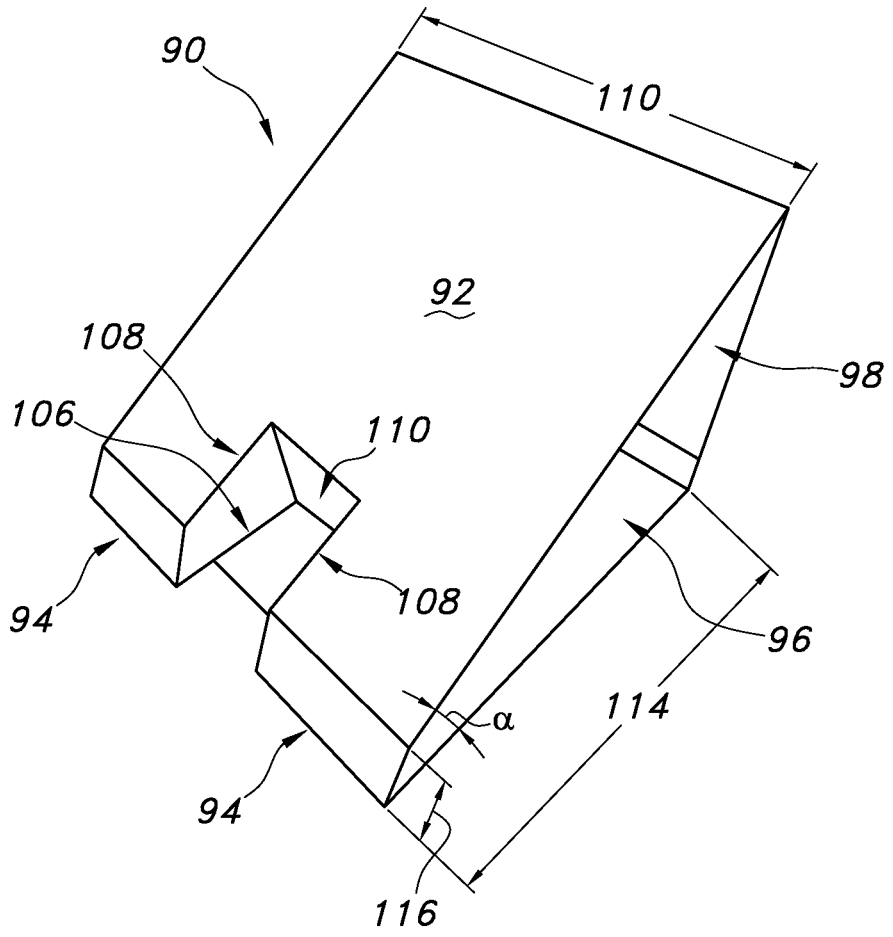
FIG. 5 illustrates a perspective view of the shelf of FIG. 4 in an assembled arrangement.

As shown in FIG. 1 and FIG. 5, the shelf 90 further includes a reach-in dispensing recess 106 formed within the front panel 94 and the ramp 92. For instance, the reach-in dispensing recess 106 can be defined by a pair of parallel cut lines 108 extending from the ramp 92, through the front panel 94 and to the bottom panel 96 of the shelf 90 to define a lower support panel 107 and an upright support panel 109 and recessed inward along a fold line 110 relative to the front panel 94 and ramp 92. When the reach-in dispensing recess 106 is recessed inward and folded along the fold line 110, the lower support panel 107 may rest against the bottom panel 96 of the shelf 90 and the upright support panel 109 may extend upright in a generally vertical direction from the bottom panel 96 to the ramp 92. In this manner, the lower support panel 107 and the upright support panel 109 may provide additional structural support to the ramp 92 to maintain the angled position of the ramp 92 against the weight of any articles 2 exerting a downward force on the ramp 92 within the dispenser 102. The reach-in dispensing recess 106 may extend symmetrically along a vertical line of symmetry of the shelf front panel 94 and the ramp 92 such that the reach-in dispensing recess 106 is centered along the shelf front panel 94 and the ramp 92.

In the embodiment illustrated in FIGS. 4-5, the lower support panel 107 and the upright support panel 109 may have generally equal size, shape and dimensions; however, the lower support panel 107 and upright support panel 109 may alternatively have unequal size, shape and/or dimensions as desired for easier reach-in capability of a user or for different support needs for the ramp 92. For instance, both the lower support panel 107 and the upright support panel 109 of the reach-in dispensing recess 106 can have a width 109*w*. The lower support panel 107 can have a height 107*h* perpendicular to the width 109*w*, and the upright support panel 109 can have a height 109*h* perpendicular to the width 109*w* and parallel to the height 107*h*. A ratio of the height 107*h* to the height 109*h* can be in the range of about 0.75:1 to about 1:0.75. In one aspect of the present invention, the height 107*h* can be in a range from about 0.75 inches to about 2 inches, for instance from about 1 inch to about 1.5 inches, such as about 1.25 inches. In one aspect of the present invention, the height 109*h* can be in a range from about 0.75 inches to about 2 inches, for instance from about 1 inch to about 1.5 inches, such as about 1.5 inches.

To provide support for the ramp 92 while maintaining the angle α of the ramp 92, a ratio of the width 109*w* of the reach-in support recess 106 to the width 112 of the shelf 90 can be in a range from about 1:10 to about 1:2, such as from about 1:6 to about 1:3, for instance about 1:4.

As illustrated in FIG. 1, the reach-in dispensing recess 106 can be aligned with the reach-in access section 66 of the dispensing opening 14 of the dispenser 12 when the shelf 90 is inserted within the internal chamber 60 of the dispenser 12. In this configuration, the reach-in access section 66 and the reach-in dispensing recess 106 can provide a space for a user to insert their fingers through the dispensing opening 14 and grasp a central portion of an article 2 from the internal chamber 60. For instance, the reach-in access section 66 and the reach-in dispensing recess 106 can be designed and arranged for easy reach-in grasping of a bridge of a lens of a piece of protective eyewear when the protective eyewear is stored within the dispenser 12.

Figure 6:
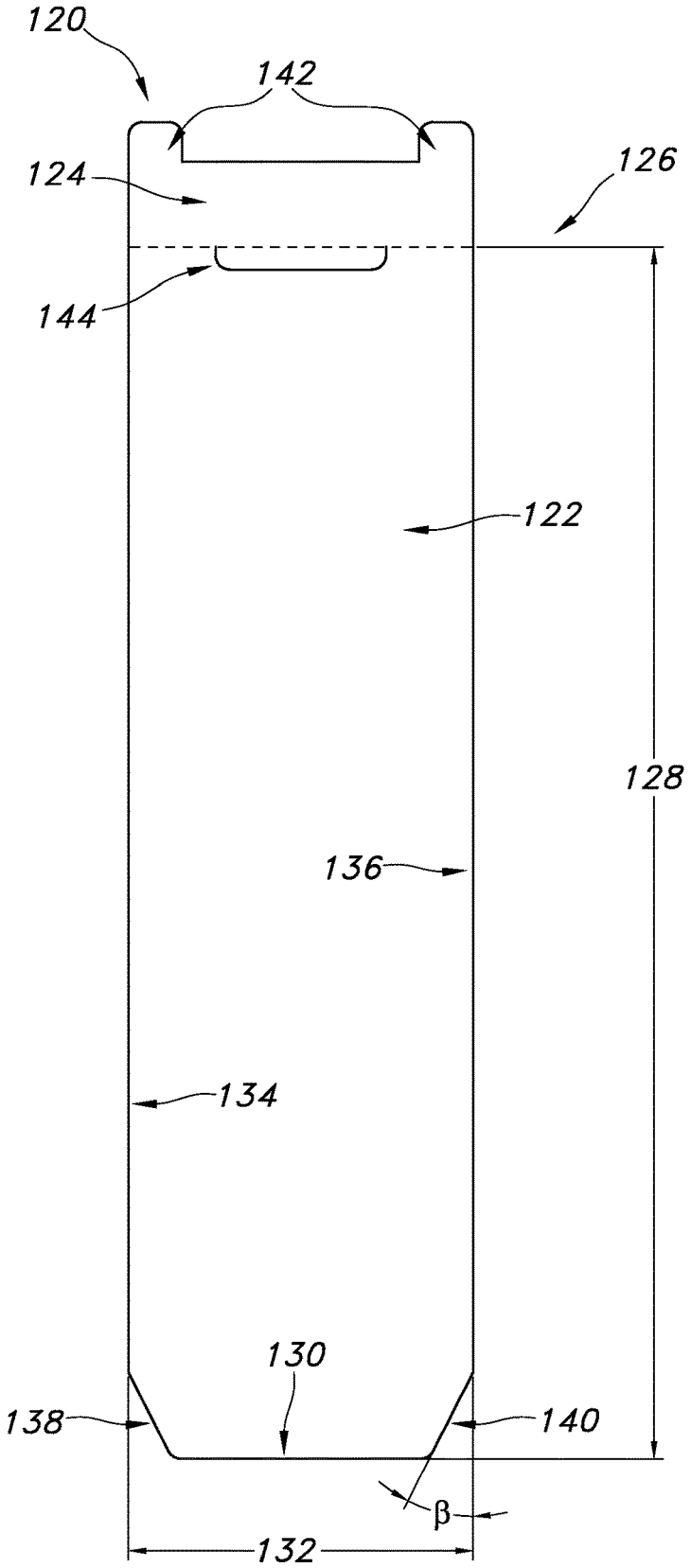
FIG. 6 illustrates a front view of an unassembled insert according to the present disclosure.

Turning now to FIG. 6, an insert 120 configured to maintain the stack of articles 2 in a predetermined arrangement within the internal chamber 60 of the dispenser 12 is shown. The insert 120 may be formed from a single piece of material, such as a generally two-dimensional piece of material such as container stock or other suitable materials described above. The insert 120 includes an insert body 122 and a retaining flap 124 extending from an upper edge of the insert body 122. The retaining flap 124 can be folded along a fold line 126 such that the retaining flap 124 is generally angled, e.g., generally perpendicular, to the body 122 of the insert 120.

The insert body 122 can have a height 128 extending from a bottom edge 130 of the insert body 122 to the fold line 126. The height 128 may be shorter than a height H of the dispenser 12. For example, the height 128 may be shorter than a distance from the top panel 24 of the dispenser 12 to the ramp 92 of the shelf 90 when the shelf 90 is inserted within the internal chamber 60 and resting on the bottom panel 26 of the dispenser 12. In one aspect of the invention, the insert body 122 may have a maximum width 132 extending from a first side edge 134 to a second side edge 136 of the insert body 122 in a horizontal direction. The first side edge 134 and second side edge 136 may be generally parallel. The insert body 122 may have a bottom edge 130 extending between the first side edge 134 and the second side edge 136. For instance, the bottom edge 128 may not extend the entire maximum width 132 of the insert body 122. Thus, the insert body 122 may further include at least a first angled edge 138 extending between the first side edge 134 and the bottom edge 130. As shown in FIG. 6, the insert body 122 may further include a second angled edge 140 extending between the second side edge 136 and the bottom edge 130. Each of the angled edges, e.g., the first angled edge 138 and the second angled edge 140, may extend at an angle β relative to the first side edge 134 and second side edge 136, respectively. The angle β may be an acute angle, for instance, a range from about 10° to about 80° relative to the first side edge 134 and second side edge 136, respectively, such as from about 15° to about 45°, for instance about 25° in one embodiment. In some aspects of the present invention, the angle β may be complementary to the angle α of the ramp 92 such that the ramp 92 and the first and second angled edges 138, 140 of the insert body 122 may correspond or be cooperating so that the structures do not interfere with each other within the internal chamber 60 or relative to the articles 2 in the internal chamber 60.

In another aspect of the present invention (not illustrated), the insert body 122 may be configured to be coupled with the shelf 90, e.g., the ramp 92 of the shelf 90, to retain a bottom edge 130 of the insert 120 in place relative to the ramp 92 and the internal chamber 60. For instance, one or more cut lines may be provided in a surface of the ramp 92 to receive the bottom edge 130 of the insert therethrough.

The insert body 122 is configured to be inserted within the dispenser 12, i.e., into the internal chamber 60 of the dispenser 12. Specifically, the top panel 24 of the dispenser 12 includes an opening 56 configured to receive the insert body 122. The opening 56 can extend from the rear side of the dispenser 12 toward the front panel 16 of the dispenser. The opening 56 has a length approximately equal to the maximum width 132 of the insert body 122. The opening 56 extends generally parallel to the first side panel 20 and the second side panel 22 of the dispenser 12. Stated differently, the opening 56 extends generally perpendicular to the front panel 16 and the rear panel 18 of the dispenser 12. In this arrangement, when the generally two-dimensional insert body 122 is inserted into the internal chamber 60, the insert body 122 is maintained in a position that is generally parallel to the first side panel 20 and the second side panel 22 of the dispenser 12 and generally perpendicular to the front panel 16 and the rear panel 18 of the dispenser 12. With the opening 56 extending generally from the rear side of the dispenser 12, the first side edge 134 of the insert body 122 may rest against the rear panel 18 of the dispenser 12. In this arrangement, the insert body 122 can separate two opposing sides of each of the articles 2 within the dispenser 12, e.g., separating the opposing arms of each pair of protective eyewear when the articles 2 include a stack of protective eyewear as shown in FIG. 1, thereby preventing tangling of the opposing arms.

Figure 7:
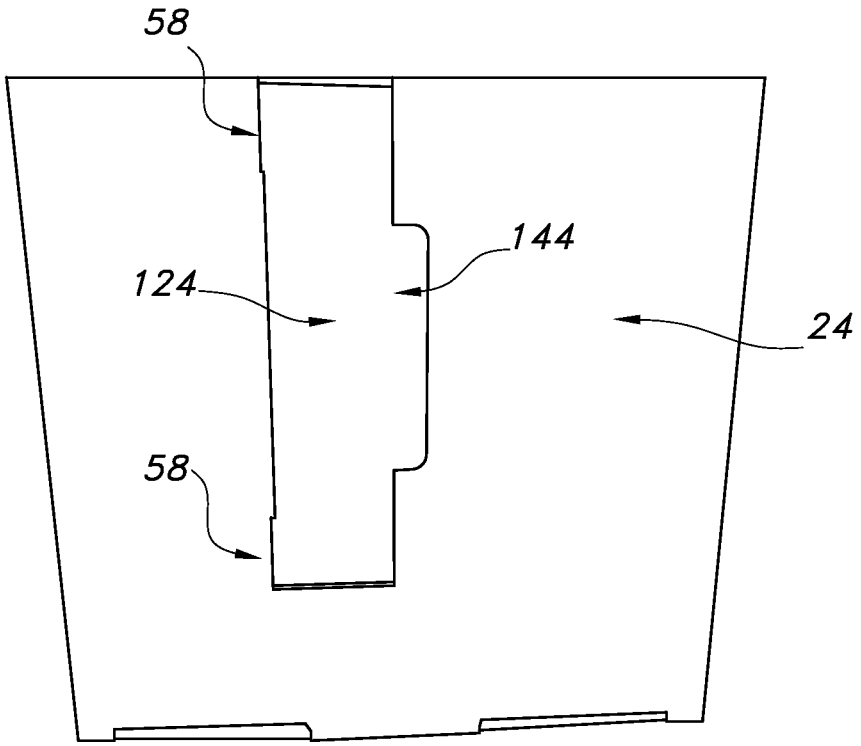
FIG. 7 illustrates a top view of a dispensing assembly in an assembled arrangement according to the present disclosure.

The retaining flap 124 of the insert 120 includes at least one retaining tab 142 extending in a direction away from the insert body 122. As shown in FIG. 6, the retaining flap 124 may include two retaining tabs 142. The retaining tabs 142 may be configured to be inserted into cooperating slots 58 formed in the top panel 24 of the dispenser 12. The slots 58 may be generally parallel to the opening 56. Opposite the retaining tab(s) 142 on the retaining flap 124, a retaining lip 144 may be provided. The retaining lip 144 may extend over the opening 56 of the top panel 24 to cover the opening 56 and prevent the retaining flap 124 from being inserted through the opening 56. As shown in FIG. 7, the retaining lip 144 may rest on the top panel 24 of the dispenser 12 generally parallel to the top panel 24.

When the insert body 122 is inserted within the dispenser 12 as described above, the insert body 122 may extend vertically within the internal chamber 60 in a manner that maintains a stack of articles 2 within the internal chamber 60. For instance, when the stack of articles 2 is formed by a stack of protective eyewear, the insert body 122 may extend vertically between the side arms of the protective eyewear from the rear panel 18 towards the front panel 16 of the dispenser 12. In this arrangement, the insert body 122 may prevent twisting and/or tangling of the side arms of adjacent articles 2 in the stack. The insert body 122 may be inserted into the dispenser after the stack of articles 2 is loaded into the internal chamber 60. As a result, the articles 2, e.g., protective eyewear, can be maintained in a vertically arranged stack, such as a vertically arranged single-file stack. As shown in FIG. 1, the protective eyewear may be stacked with each protective eyewear article upside down (i.e., arms down and lens facing up) at the bottom of the dispenser 12 (e.g., resting on the shelf 90) with the lenses presented toward the front panel 16 of the dispenser 12. As described above, the nose 72 may catch on the bridge of the lens of each protective eyewear article 2 to enable and aid with easy pulling dispensing of a single protective eyewear article at a time, i.e., one-by-one dispensing.

In some aspects of the present invention, more than one insert 120 may be included in the dispenser assembly 100 and inserted within the dispenser 12. For example, two parallel inserts 120 may be inserted vertically within the dispenser 12. Additionally or alternatively, rather than a generally two-dimensional insert 120 as described above, the insert 120 may have a three-dimensional shape such as a V-shape or U-shape within the dispenser 12 to suit the various support needs based on the selected articles 2 within the dispenser 12.

The plurality of articles as described herein is desirably a plurality of disposable articles. As used herein, the term "disposable" refers to a product that may be discarded after only a single use, for instance a product that is so inexpensive that it may be economically discarded after a single use or a product that is used in a healthcare setting that requires sanitary single use of the product to reduce the potential for contamination or infection. Products that are "disposable" are typically intended for single use. The term "single-use" refers to a product that is intended to be used only once and is not intended to be re-used, re-conditioned, restored or repaired after that use. Such products offer advantages in clinical settings by reducing the potential for contamination or infection. In addition, these products can enhance workflow since they are not collected and assembled for reprocessing and reuse. Examples of disposable articles include disposable eyewear (e.g., face shields, safety glasses, goggles, etc.), disposable face masks, disposable examination gloves, and the like.

While various patents have been incorporated herein by reference, to the extent there is any inconsistency between incorporated material and that of the written specification, the written specification shall control. In addition, while the disclosure has been described in detail with respect to specific embodiments thereof, it will be apparent to those skilled in the art that various alterations, modifications and other changes may be made to the disclosure without departing from the spirit and scope of the present disclosure. It is therefore intended that the claims cover all such modifications, alterations and other changes encompassed by the appended claims.

What is claimed is:

1. A dispensing assembly, comprising:

a dispenser comprising a front panel, a rear panel, a top panel, a bottom panel, a first side panel, and a second side panel, wherein the front panel, the rear panel, the top panel, the bottom panel, the first side panel, and the second side panel define an internal chamber configured to receive a stack of articles;

a dispensing opening, wherein at least a portion of the dispensing opening is formed in the front panel, wherein a portion of the front panel forms a nose extending toward the dispensing opening to assist with one-by-one dispensing of articles from the stack through the dispensing opening, wherein a first side of the opening is defined by the first side panel and a second side of the opening is defined by the second side panel; and a shelf contained within the internal chamber; and an insert configured to maintain the stack of articles in a predetermined arrangement within the internal chamber, wherein the insert comprises at least one retaining flap configured to be coupled with the top panel of the dispenser, wherein the insert comprises a body extending in a vertical direction within the internal chamber, the body defining a first side generally parallel to a second side configured to be disposed perpendicular to the front panel and the rear panel of the dispenser, and wherein the insert comprises a bottom edge extending between the first side of the insert and the second side of the insert, wherein the insert further comprises a first angled edge extending between the first side of the insert and the bottom edge and a second angled edge extending between the second side of the insert and the bottom edge, wherein the first angled edge and the second angled edge each extend at an angle in a range from about 10 to about 80 degrees, relative to the bottom edge.

2. The assembly of claim 1, wherein the insert is configured to be inserted into the internal chamber through the top panel of the dispenser, further wherein at least a portion of the insert remains outside the internal chamber when the insert is inserted through the top panel of the dispenser.

3. The assembly of claim 1, wherein the body is configured to be disposed generally parallel to the first side panel and the second side panel of the dispenser.

4. The assembly of claim 1, wherein at least one of the front panel, the rear panel, the top panel, the bottom panel, the first side panel, and the second side panel is constructed of carton cardboard stock, paperboard, heavy structural paper, container stock, corrugated paperboard, plastic coated paper, a plastic sheet, a wax-coated paper, or a combination thereof.

5. The assembly of claim 1, wherein the shelf and the insert are each constructed of carton cardboard stock, paperboard, heavy structural paper, container stock, corrugated paperboard, plastic coated paper, a plastic sheet, a wax-coated paper, or a combination thereof.

6. The assembly of claim 1, wherein the articles comprise personal protective equipment in the form of a face shield, glasses, or goggles.

7. The assembly of claim 1, wherein the angle of the first angled edge and/or second angled edge corresponds to an angle of the shelf.

8. The assembly of claim 1, wherein the shelf comprises a ramp, wherein the ramp is configured to be disposed at an angle relative to a horizontal plane, wherein the angle is in a range from about 20° to about 80°.

9. The assembly of claim 8, wherein the shelf comprises a front panel extending generally parallel to the front panel of the dispenser, further wherein the ramp extends from the front panel of the shelf in a direction towards the rear panel of the dispenser.

10. The assembly of claim 9, wherein the shelf comprises a recessed reach-in portion formed through at least a portion of the front panel of the shelf and at least a portion of the ramp of the shelf.

11. The assembly of claim 8, wherein the shelf further comprises a bottom panel, wherein the bottom panel of the shelf comprises an attachment configured to be coupled with the dispenser.

12. The assembly of claim 1, wherein at least a portion of the dispensing opening is formed in the bottom panel.

13. The assembly of claim 12, wherein the assembly comprises a reach-in access feature defined by at least a portion of the dispensing opening and at least a portion of the shelf.

14. The assembly of claim 13, wherein the reach-in access feature is formed by a recessed reach-in portion of the shelf.

15. The assembly of claim 13, wherein the reach-in access feature is formed by the portion of the dispensing opening formed in the bottom panel.

16. The assembly of claim 15, wherein the portion of the dispensing opening formed in the bottom panel and a recessed reach-in portion of the shelf are aligned in a vertical direction, wherein the vertical direction extends from the top panel to the bottom panel.

17. The assembly of claim 1, further comprising a dust cover insert configured to cover an entirety of the dispensing opening.

* * * * *